US009863426B2

(12) United States Patent
Mönk et al.

(10) Patent No.: US 9,863,426 B2
(45) Date of Patent: Jan. 9, 2018

(54) SEAL OF A COMPRESSOR ROTOR

(71) Applicant: SIEMENS AKTIENGESELLSCHAFT, München (DE)

(72) Inventors: Thomas Mönk, Gladbeck (DE); Wolfgang Zacharias, Duisburg (DE)

(73) Assignee: SIEMENS AKTIENGESELLSCHAFT (DE)

( * ) Notice: Subject to any disclaimer, the term of this patent is extended or adjusted under 35 U.S.C. 154(b) by 229 days.

(21) Appl. No.: 14/652,255

(22) PCT Filed: Dec. 18, 2013

(86) PCT No.: PCT/EP2013/077143

§ 371 (c)(1),
(2) Date: Jun. 15, 2015

(87) PCT Pub. No.: WO2014/096036

PCT Pub. Date: Jun. 26, 2014

(65) Prior Publication Data

US 2015/0330395 A1 Nov. 19, 2015

(30) Foreign Application Priority Data

Dec. 19, 2012 (DE) ..... 10 2012 223 830

(51) Int. Cl.
*F04D 17/12* (2006.01)
*F04D 29/12* (2006.01)
(Continued)

(52) U.S. Cl.
CPC ..... *F04D 17/12* (2013.01); *F04D 17/122* (2013.01); *F04D 29/102* (2013.01); *F04D 29/12* (2013.01);
(Continued)

(58) Field of Classification Search
CPC ..... F04D 17/12; F04D 17/122; F04D 29/102; F04D 29/104; F04D 29/122; F05D 2240/61; F16D 2001/103; F16D 2001/102
(Continued)

(56) References Cited

U.S. PATENT DOCUMENTS 3,360,272 A * 12/1967 Blom ..... F04D 29/128 277/348
3,680,979 A 8/1972 Hansen et al.
(Continued)

FOREIGN PATENT DOCUMENTS

CN 1269872 A 10/2000
CN 102235373 A 11/2011
(Continued)

OTHER PUBLICATIONS

Getriebeturboverdichter; Getriebeturboverdichter, "Effizient und anerkant: Siemens Getriebeturboverdichter" http://www.energy.siemens.com/hq/de/verdichtung-expansion-ventilation/turboverdichter/getriebeturboverdichter/stc-gc.htm; 2012; (translation enclosed).

(Continued)

*Primary Examiner* — Matthew W Jellett
(74) *Attorney, Agent, or Firm* — Schmeiser Olsen & Watts LLP

(57) ABSTRACT

A compressor rotor comprising a pinion shaft which has multiple interconnected segments that are arranged axially one behind the other and including a multipart seal which seals the pinion shaft is provided. The pinion shaft has a rotor segment which supports a rotor, a connection segment, and a toothed segment arranged axially between the rotor segment and the connection segment, the toothed segment having a toothing at each of the two ends of the toothed segment. The toothed segment is held axially between the
(Continued)

rotor segment and the connection segment via toothings by means of corresponding mating toothings at ends of the rotor segment and the connection segment, and a multipart seal sealing element which is connected to the toothed segment in an at least force-fitting manner is arranged on said toothed segment.

6 Claims, 1 Drawing Sheet

(51) Int. Cl.
*F04D 29/62* (2006.01)
*F04D 29/10* (2006.01)
*F04D 29/64* (2006.01)

(52) U.S. Cl.
CPC ..... *F04D 29/122* (2013.01); *F04D 29/62* (2013.01); *F04D 29/624* (2013.01); *F04D 29/644* (2013.01)

(58) Field of Classification Search
USPC ..... 415/110–113, 230; 416/244 R
See application file for complete search history.

(56) References Cited

U.S. PATENT DOCUMENTS 3,874,824 A * 4/1975 Cronstedt ..... F01D 5/026 403/296
RE28,540 E * 9/1975 Ball ..... F04D 1/006 415/111
4,993,917 A * 2/1991 Kulle ..... F01D 3/04 277/361
5,028,204 A * 7/1991 Kulle ..... F04D 29/051 415/105
5,468,002 A * 11/1995 Wasser ..... F16J 15/3404 277/361
8,985,587 B2 * 3/2015 Alfes ..... F16J 15/3484 277/370
9,500,201 B2 * 11/2016 Hutten ..... F04D 29/023
9,518,473 B2 * 12/2016 Mateman ..... F16J 15/002
2011/0262284 A1 10/2011 Guernard

FOREIGN PATENT DOCUMENTS

DE 2249974 B2 4/1975
DE 102009015862 A1 10/2010
EP 1209388 A2 5/2002

OTHER PUBLICATIONS

International Search Report for PCT Application No. PCT/EP2013/077143, dated Feb. 27, 2014.

* cited by examiner

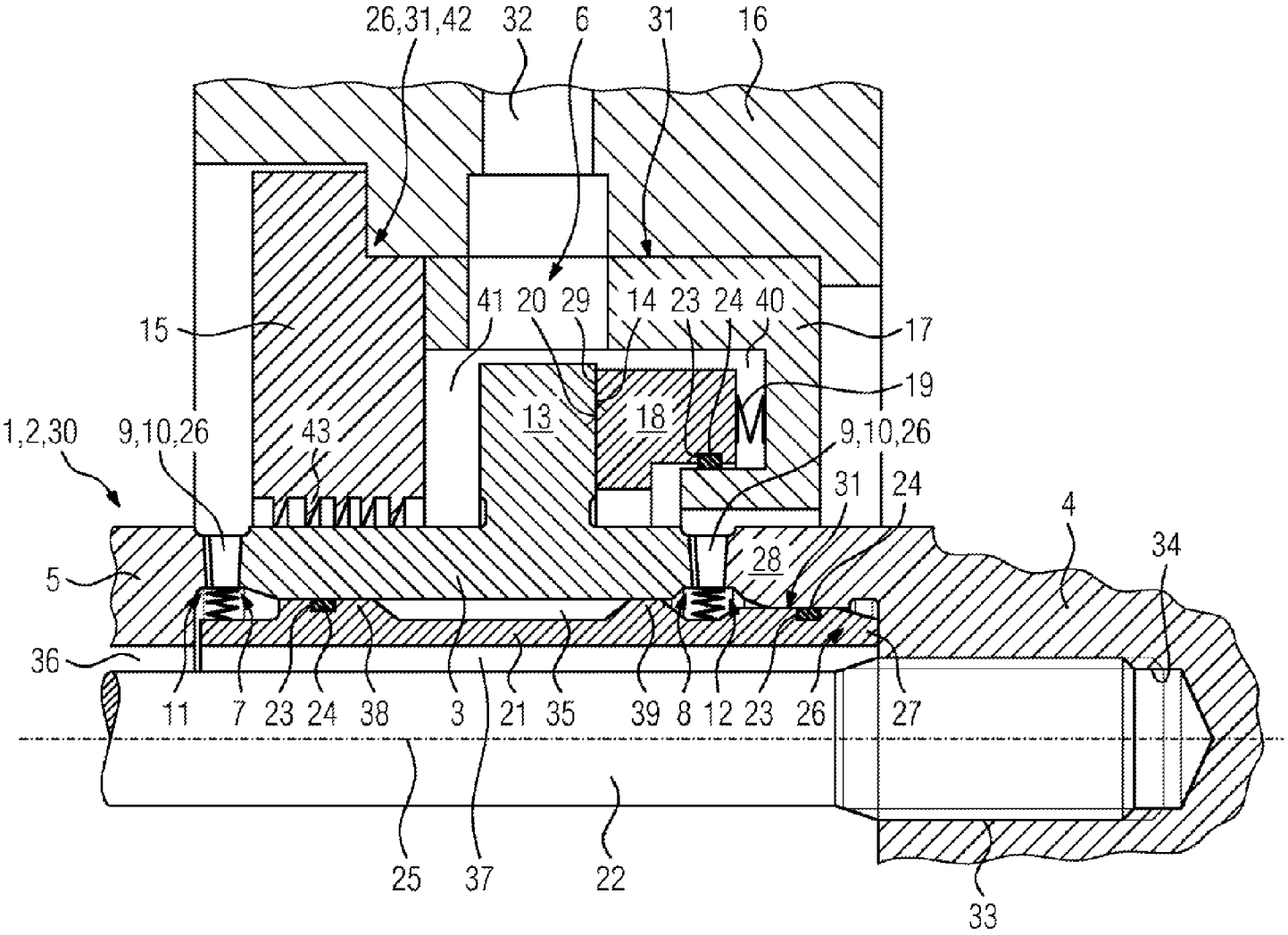
34
4
33
17
19
9,10,26
24
27
31
26
16
40
28
23
24
12
23
8
31
14
18
39
22
6
29
35
20
13
21
32
41
37
3
26,31,42
25
38
43
24
23
7
15
9,10,26
11
1,2,30
5
36

SEAL OF A COMPRESSOR ROTOR

CROSS-REFERENCE TO RELATED APPLICATIONS

This application claims priority to PCT Application No. PCT/EP2013/077143 having a filing date of Dec. 18, 2013, based off of DE 102012223830.1 having a filing date of Dec. 19, 2012, the entire contents of which are hereby incorporated by reference.

FIELD OF TECHNOLOGY

The following relates to a compressor rotor, in particular for a turbo compressor, such as a geared compressor, having a pinion shaft, which has a plurality of interconnected segments that are arranged axially in series, and having a multipart seal, which seals the pinion shaft.

BACKGROUND

Compressors or fluid-compressing devices are used in various sectors of industry for various applications where compression of fluids, especially (process) gases, is required.

Known examples of this are turbocompressors in mobile industrial applications, such as in exhaust turbochargers or in jet motors, or in stationary industrial applications, such as geared compressors or geared turbocompressors for air separation.

With such a turbocompressor—which operates in a continuous operating mode—the increase in the pressure (compression) of the fluid is brought about by increasing an angular momentum of the fluid from the inlet to the outlet by means of a rotating turbocompressor impeller having radially extending blades and carried by a compressor rotor, by rotation of the blades. Here, i.e. in such a compressor stage, the pressure and temperature of the fluid increase, while the relative (flow) velocity of the fluid in the impeller or turbo impeller falls.

In order to achieve a pressure increase or compression of the fluid which is as high as possible, a plurality of such compressor stages can be arranged in series.

Among the designs of turbocompressor, a distinction is drawn between radial and axial compressors. In the case of the axial compressor, the fluid to be compressed, e.g. a process gas, e.g. air or carbon dioxide, flows through the compressor in a direction parallel to the axis (axial direction). In the case of the radial compressor, the gas flows axially into the impeller of the compressor stage and is then deflected outward (radially, radial direction). In the case of multistage radial compressors, a flow deflection is required after each stage.

Combined designs of axial and radial compressors draw in large volume flows by means of their axial stages, these being compressed to high pressures in the following radial stages.

Whereas single-shaft machines (single-shaft turbocompressors) with a (pinion) shaft carrying one or more impellers—also referred to below for short as a compressor rotor unit—are generally used, the individual compressor stages in (multistage) geared turbocompressors (also referred to below for short as geared compressors) are grouped around a gear, wherein, in this case, a plurality of parallel (pinion) shafts, which each carry one or two impellers (turbo impellers arranged at free shaft ends of the pinion shafts)—accommodated in pressure-resistant spiral housings implemented as housing attachments and allowing flow to and from the compressor stages—as a compressor rotor unit, also referred to below for short as a compressor rotor—are driven by a large driving gearwheel mounted in the housing, a gear.

In the pressure-resistant spiral housing, i.e. in a cylindrical bore in the spiral housing, a spiral insert is inserted—in addition to the impeller or compressor rotor carried by the pinion shaft—in such a way that, axially at the end, the spiral insert still has available to it, in the cylindrical bore of the spiral housing, a spacing enclosed by the spiral housing and the spiral insert, referred to as an annular space, via which the fluid—coming from the impeller—flows out radially via a widening cross section.

Via system piping, such as a pressure stub pipe arranged on the spiral housing or on the (housing) pot and having a pressure stub flange arranged thereon, the fluid then flows onward from the annular space and out of the compressor stage.

The fluid flows into the spiral housing via a spiral intake flange, which is designed as a housing cover (situated axially at the end) and which closes off the spiral housing axially.

A geared compressor of this kind, a geared compressor produced by Siemens designated STC-GC or STC-GV, which is used for air separation, is known from http://www.energy.siemens.com/hq/de/verdichtung-expansion-ventilation/turboverdichter/getriebeturboverdichter/stc-gc.htm or http://www.energy.siemens.com/hq/de/verdichtung-expansion-ventilation/turboverdichter/getriebeturboverdichter/stc-gv.htm (accessed on Dec. 18, 2012).

Assembled rotors for radial compressors are known from US 2011/262284 A1 and U.S. Pat. No. 3,680,979A1 respectively.

To avoid/reduce pressure losses in the compressor stage and/or to prevent (possibly dangerous) process gas from flowing out of the compressor stage (leakage), the pinion shaft carrying the impeller, or compressor rotor, of a turbocompressor of this kind requires a seal between the process gas (in the interior of the compressor stage) to be compressed and an external environment, and said seal must meet different requirements, depending on the type of process gas and the pressure of the process gas (sealing pressure).

One known practice for such sealing is to use seals, such as labyrinth seals or gas seals, arranged on the pinion shaft, which have seal elements that rotate with the pinion shaft and/or do not rotate/are fixed.

Labyrinth seals and gas seals, either in single or double form, are sufficiently well known.

Specifically in the case of compressor rotor designs with overhanging impeller masses or overhung impellers, such as particularly in the case of geared compressors, centering with as little play as possible of all the components which co-rotate—with the compressor rotors—is implemented in order to reduce loads due to unbalance, especially at a high rotor speed, and the resulting damage (especially in the case of high-speed compressor stages), and it is thereby possible to avoid shifting of the co-rotating components relative to the axis of rotation of the compressor rotors or shifting of the axis of rotation of the rotating components, said shifting causing (operating) unbalance.

This applies especially also to co-rotating seal elements, especially also those of gas seals, the (co-rotating) masses of which can assume orders of magnitude which are relevant especially also to impeller masses.

Particularly in the case of gas seals with rotating seal elements, centering of the rotating seal elements is only possible through tight tolerances and/or additional centering elements, however. Moreover, it is generally impossible in that case to embody the connection between rotating seal elements and the carrier elements thereof without play, and therefore shifting of the axis of rotation of the rotating seal elements is possible to a limited extent (operating unbalance).

SUMMARY

An aspect relates to a seal of a compressor rotor which ensures reliable sealing of the compressor rotor, is of simple construction and can be implemented at low cost and is also simple to install. Moreover, the seal should also make it possible to implement compressor rotors, especially high-speed compressor rotors, as far as possible without operating unbalance.

The compressor rotor has a pinion shaft, which has a plurality of interconnected segments that are arranged axially in series, and a multipart seal, in particular a gas seal, which seals the pinion shaft.

In this context, embodiments of the invention use the phrases "axially in series" or "pinion shaft segments arranged axially in series" to mean that—in relation to an axis of rotation of the pinion shaft or compressor rotor—said pinion shaft segments are arranged in a—direct or, alternatively, indirect—axial sequence—in the axial direction of the axis of rotation.

According to embodiments of the invention, it is envisaged that the pinion shaft has an impeller segment, which has or carries an impeller, a connection segment, and a toothed segment arranged axially between the impeller segment and the connection segment.

The segments can be bodies which are substantially cylindrical and/or rotationally symmetrical with respect to the axis of rotation of the compressor/axis of rotation of the pinion shaft. The toothed segment, in particular, can be designed as a substantially cylindrical, rotationally symmetrical hollow body.

According to embodiments of the invention, the toothed segment has toothing at each of the two (axial) ends thereof, whereby the toothed segment is held axially between the impeller segment and the connection segment by means of corresponding mating toothing at (axial) ends of the impeller segment and of the connection segment.

In this case, embodiments of the invention uses the phrase "held by means of corresponding mating toothing"—corresponding to the toothing—to mean that the toothing (at the axial end of a segment) and the mating toothing (at the axial end of the other segment) are in engagement, as a result of which a positive connection for force and motion transmission is obtained between the two segments.

If the toothing and the mating toothing are provided as serrated toothing or as a serrated joint, for example, it is thereby possible for the toothed segment to be held axially and in a manner centered without play between the impeller segment and the connection segment.

It is furthermore envisaged according to embodiments of the invention that a seal element of the multipart seal, e.g. of the gas seal, is arranged on the toothed segment, said seal element being connected at least nonpositively to the toothed segment.

Expressed in a simplified and clear way, the seal element connected at least nonpositively to the toothed segment is a part or the part of the seal which co-rotates with the pinion shaft or compressor rotor (in the operating state).

Expressed in a clear and simplified way, it is envisaged according to embodiments of the invention that the/a rotating part/element of the multipart seal thus becomes a "constituent part" of the pinion shaft—through the at least nonpositive connection—whereby play-free centering of the rotating part/element of the seal is then possible—by means of the toothed segment, which is held by means of the toothing (at both ends), in particular which can be held by the toothing, specifically by the serrated toothing, in a manner centered without play.

Additional centering elements and other tight tolerances, as otherwise customary, can thus be eliminated by means of embodiments of the invention, or are no longer necessary. (Component) costs, weight and/or additional assembly steps and/or processing steps are thus likewise eliminated by embodiments of the invention or are no longer necessary.

Embodiments of the invention thus make available a reliable seal for a compressor rotor, which seal is simple in construction, can be implemented at low cost and is simple to install.

It is also possible, by means of the simply achieved play-free centering—possible by means of embodiments of the invention—of (co-)rotating seal elements to avoid operating unbalance, given that shifting of the axis of rotation is not possible or is largely no longer possible.

It is also possible in this way, by virtue of embodiments of the invention, to achieve higher speeds at the compressor rotor or in a turbocompressor having such a compressor rotor. It is thus also possible to implement more powerful turbocompressors.

Embodiments of the invention also makes it possible to achieve smaller outside diameters for the (rotating) seal element (and therefore also for the seal or elements thereof overall). This leads to a lower peripheral speed at the seal element. It is thereby possible, in turn, to achieve higher speeds with the compressor rotor.

According to a preferred development, the toothing and/or the mating toothing is/are designed as serrated toothing or a serrated joint. Serrated toothing/a serrated joint of this kind is simple to manufacture, is of small size and—while allowing the two elements connected thereby to be released—allows connection of the elements in a manner centered without play.

As a particularly preferred option, the multipart seal sealing the pinion shaft is a gas seal, e.g. a single or double gas seal.

According to another preferred development, a further seal—in addition to the multipart seal which seals the pinion shaft—e.g. a labyrinth seal, which is arranged on the toothed segment, is provided. It is thereby possible to further increase the sealing effect or sealing of the compressor rotor.

The embodiment of the gas seal and the type and embodiment of the further seal can be chosen in accordance with the process medium and/or the sealing pressure.

According to another preferred development, it is envisaged that the seal element of the multipart seal, said seal element being connected at least nonpositively to the toothed segment, is formed in positive engagement or integrally with the toothed segment.

Particularly in the case of integral formation of the seal element with the toothed element, it is possible to eliminate a separate component which would otherwise be necessary. Fits and/or centering locations which would otherwise also be necessary if the seal element were embodied separately are no longer necessary. The assembly of the compressor rotor is simplified.

According to another preferred development, it is envisaged that the seal element of the multipart seal, said seal element being connected at least nonpositively to the toothed segment, has a substantially radial sealing surface in relation to the axis of rotation of the compressor rotor or pinion shaft.

Here, it is furthermore possible to provide a further seal element of the multipart seal, which seal element is arranged in a manner which allows substantially axial movement, in particular by means of a spring, in a stator, in particular a stator arranged on a housing element.

This nonrotating seal element can (likewise) have a substantially radial sealing surface, which lies axially opposite the substantially radial sealing surface of the seal element of the multipart seal, said seal element being connected at least nonpositively to the toothed segment or co-rotating.

Expressed more simply, the—substantially—radial sealing surface of the rotating seal element and the—substantially—radial sealing surface of the nonrotating seal element rest against one another in sealing contact—by virtue of the axial movement, effected by the spring, of the nonrotating seal element—or—particularly in the case of a gas seal—form a radial sealing gap, in which a gas cushion builds up—and thereby ensure sealing.

With such radial alignment of the sealing surfaces on the seal elements of the multipart seal, it is thus also possible to achieve a small or even smaller outside diameter with the (rotating) seal element (and thus also in the case of the seal or its elements overall). This leads to a lower peripheral speed at the seal element. As a result, in turn, higher speeds of the compressor rotor can be achieved. Moreover, it is thereby also possible to eliminate centering or centering elements—as would otherwise be necessary in the case of seal elements with sealing surfaces which were axial with respect to one another; tolerances can be wider. The seal becomes simpler in construction and less expensive and is easier to assemble.

According to another preferred development, it is envisaged that the toothed segment—which is, in particular, designed as a substantially cylindrical, rotationally symmetrical hollow body is arranged on a (cylindrical) sleeve, which is sealed with respect to the toothed segment, in particular.

At one axial end, this sleeve can have an axial centering extension, which centers the sleeve relative to another pinion shaft segment, in particular relative to the connection segment, to allow easier assembly of the toothed segment or pinion shaft/compressor rotor.

For this purpose, the other pinion shaft segment or connection segment can likewise have a corresponding axial centering extension at its axial end facing the sleeve, whereby the centering of the sleeve and the pinion shaft segment or connection segment can be accomplished.

In order to prevent (process) gas from flowing out via the toothing of the toothed segment and via contact surfaces which arise on account of the sleeve (with respect to the toothed segment and/or with respect to the other pinion-shaft/connection segment), it is expedient to seal the sleeve with respect to the toothed segment and/or to seal the sleeve with respect to the other pinion-shaft (connection segment).

For this purpose, it is possible, in particular, to provide O-rings. For this purpose, corresponding circumferential grooves can be provided on the outer circumference of the sleeve (in the corresponding contact regions of the sleeve and the toothed segment or the sleeve and the other pinion-shaft/connection segment at that location), in which the sealing elements or O-rings are placed.

It is also possible to envisage that the segments of the pinion shaft, which has a plurality of interconnected segments arranged axially in series, are clamped by means of a reduced-shank bolt, whereby the toothed segment is held clamped axially between the impeller segment and the connection segment—without play and in a centered manner. If a gas seal is provided as the multipart seal, the gas seal can be designed for a gas pressure of approximately 3 bar-5 bar but also for higher gas pressures of about 200 bar-250 bar, as in the case of carbon dioxide applications for example.

According to another development, the impeller is overhung. That is to say, the support for the pinion shaft or compressor rotor is provided on one side of the impeller, with the result that the impeller arranged on the impeller segment is situated at a free end of the pinion shaft.

Such support arrangements are generally provided for the compressor rotors of compressor stages in geared compressors (overhung stage).

As a preferred option, it is furthermore possible to envisage that the compressor rotor is used in a turbocompressor, in particular a high-speed compressor. In this context, the term "high-speed" can be taken to mean that a rotor speed is approximately in a range of from 20,000 rpm-40,000 rpm or even above.

Here, the turbocompressor can be a single-shaft compressor.

It is also possible for the turbocompressor to be a geared compressor. In other words, the compressor rotor in another preferred development is installed in a compressor stage in a geared turbocompressor.

The description given hitherto of advantageous embodiments of the invention contains numerous features which are reproduced in the individual dependent claims, with several features being combined in some cases. However, it will also be expedient for a person skilled in the art to consider these features individually and to combine them into worthwhile further combinations.

BRIEF DESCRIPTION

Some of the embodiments will be described in detail, with reference to the following figures, wherein like designations denote like members, wherein:

FIG. 1 shows a longitudinal section through a portion of an embodiment of a geared compressor rotor (part of an overhung stage) having a multipart pinion shaft.

DETAILED DESCRIPTION

FIG. 1 shows a longitudinal section through a portion of a geared compressor rotor 1 (referred to below merely as a compressor rotor 1 for short) of a geared compressor 30 having a multipart pinion shaft 2.

The compressor rotor 1 can be embodied either with one overhung impeller (not shown) (an overhung stage of the geared compressor) arranged on the pinion shaft 2 or with two overhung impellers arranged on the pinion shaft 2 (impellers not shown) (two overhung stages).

In the case of a design with two impellers arranged on the respective axial end regions of the pinion shaft 2, FIG. 1 can be regarded as a half-illustration showing just one axial end region of the pinion shaft 2—with a corresponding illustration as a mirror image (not shown) for the other axial end region of the pinion shaft 2.

The compressor rotor 1 is driven/rotated via a transmission (not shown), which connects a drive unit, e.g. a steam turbine or an electric motor, to the pinion shaft 2 for power transmission via toothing (not shown).

Direct driving of the compressor rotor 1 would likewise be possible as an alternative.

In the present case, the starting point is a high-speed compressor rotor 1 or a high-speed pinion shaft 2 with speeds in a range of from about 20,000 rpm-40,000 rpm.

As FIG. 1 shows, the pinion shaft 2 has three segments 3, 4 and 5, which are arranged axially in series along its axis of rotation 25, wherein a connection segment 4 of the pinion shaft 2 is arranged on the driving side, and an impeller segment 5 of the pinion shaft 2, carrying the impeller (forming the overhung stage, not shown), is arranged on the impeller side.

A further segment 3 of the pinion shaft 2, the toothed segment 3 of the pinion shaft 2, is arranged axially between the impeller segment 5 and the connection segment 4—and is connected for conjoint rotation therewith.

Whereas the connection segment 4 is designed as a substantially cylindrical, rotationally symmetrical solid body, the impeller segment 5 (carrying the impeller (not shown)) and the toothed segment 3 are implemented as substantially cylindrical, rotationally symmetrical hollow bodies (sleeves).

The joints between the toothed segment 3 and the impeller segment 5 at one end (axially) and the toothed segment 3 and the connection segment 4 at the other end (axially) are designed as serrated joints, wherein serrated toothing 9 and the corresponding serrated mating toothing 10 is formed on the respective axial ends 7 and 11 of the toothed segment 3 and of the impeller segment 5 and the respective axial ends 8 and 12 of the toothed segment 3 and of the connection segment 4.

A (centering) sleeve 21, which carries/supports the toothed segment and centers the toothed segment 3, is arranged within the (through) hole 35 in the hollow-cylindrical toothed segment 3.

The sleeve 21 is supported against the toothed segment 3 by means of two extensions 38, 39, which are provided on the outer circumference of the sleeve 21, are integral with the sleeve 21 and make contact with the inner circumference of the toothed segment 3 in the cylindrical through hole 35 therein.

During the assembly of the compressor rotor, the centering of the toothed segment is accomplished using an axial, hollow-cylindrical centering extension 27 on the axial end of the sleeve 21 facing the connection segment 4, at one end, and a corresponding, hollow-cylindrical, axial centering extension 28 on the axial end of the connection segment 4 facing the toothed segment 2, at the other end, said centering extension surrounding the hollow-cylindrical centering extension 27 of the sleeve 21 radially (with a fit 31)—in the assembled state—by introducing/inserting the sleeve 21 or the centering extension 27 thereof into the centering extension 28 of the connection segment 4 until the axial end of the sleeve 21 makes contact with the axial base of the centering extension 28 of the connection segment 4—and then by pushing the toothed segment 3 onto the sleeve 21 until the serrated toothing 9 on the toothed segment 3 engages in the mating toothing 10 on the connection segment 4.

In order to prevent (process) gas from flowing out via the serrated joints or the serrated toothing 9, 10 and via the contact surfaces from the sleeve 21 to the toothed segment 3 and from the sleeve 21 to the connection segment 4, the sleeve 21 is sealed with respect to the toothed segment 3 and with respect to the connection segment 4.

For this purpose, the sleeve 21 has two circumferential grooves 23—in the supporting extension 38 and in the centering extension 27—in which sealing elements 24, in this case O-rings 24, are placed.

By means of a reduced-shank bolt 22—screwed at one end (screwed joint 33) into an (axial) threaded hole 34 in the connection segment 4, passed through cylindrical recesses/holes 35, 36, 37 in the sleeve-type toothed segment 3, the (sleeve-type) centering sleeve 21 and the sleeve-type impeller segment 5, and secured at the other end by means of a retaining nut (not shown) screwed onto the reduced-shank bolt 22 and supported against a shoulder (not shown) in the sleeve-type impeller segment 5—the three segments, i.e. the connection segment 4, the toothed segment 3 and the impeller segment 5, are clamped against one another, thereby holding the toothed segment 3 axially between the impeller segment 5 and the connection segment 4.

On the one hand, it is possible by means of the serrated joints for high forces and torques to be transmitted via/in the pinion shaft 2 and—on the other hand—it is possible by means of these to achieve play-free centering 26 of the toothed segment 3 (axially between the impeller segment 5 and the connection segment 4).

Additional centering elements as well as tight tolerances on the components are no longer necessary. Rotation-induced shifting (centrifugal force) of the axis of rotation of the toothed segment 3 or of the axis of rotation 25 of the pinion shaft 2/compressor rotor 1, which would lead to operating unbalance, is prevented.

As FIG. 1 furthermore shows, the sealing of the compressor rotor 1 or pinion shaft 2—to prevent leakage of process gas from the compressor stage—is accomplished by means of a single gas seal 6, the latter having a plurality of (rotating and fixed/nonrotating) seal elements 13, 17, 18, 19, 23, 24, in conjunction with a labyrinth seal 15.

Depending on the application, this gas seal 6 is operated with pressurized sealing gas, e.g. at 3 bar-5 bar or even 200 bar-250 bar.

It is also possible, in a manner corresponding to this single gas seal 6, for other embodiments or forms of seal or gas seals, e.g. a double gas seal, to be provided.

A first seal element 13 (—co-rotating with the pinion shaft 2 or compressor rotor 1—) of the gas seal 6 is arranged—in the form of an annularly encircling, radially outward-extending extension 13 connected integrally to the toothed segment 3—on the toothed segment 3.

The first seal element 13 of the gas seal 6, which is connected integrally to the toothed segment 3, is thus an integral part of the toothed segment 3—and hence also a constituent part of the pinion shaft 2 or compressor rotor 1—and co-rotates with the toothed segment 3 or pinion shaft 2 or compressor rotor 1.

In the (axial) region of this first seal element 13, the sleeve 21 is provided with a very slight shrinkage, which does not allow expansion under operating conditions. The centrifugal force which occurs promotes this effect.

A stator 17—as a fixed, nonrotating component 17 of the gas seal 6—is held by means of a fit 31 in a housing part 16 of the compressor stage of the geared compressor 30. Via a hole 32 in the housing part 16 and via said stator 17, the sealing gas flows—under pressure—into a cavity 41 of the gas seal 6 and, via the hole 32 in the housing part 16 and via said stator 17, the gas seal 6 is supplied with the sealing gas.

A further nonrotating component 18 of the gas seal, an annular seal body 18, is arranged—in a manner which allows axial movement by means of a spring 19—in an axial annular recess 40 in the stator 17 arranged approximately at the radial height of the annularly encircling, radially outward-extending extension 13 on the toothed segment 3 (rotating component 13/first seal element 13 of the gas seal 6), said further nonrotating component thus likewise being arranged approximately at the radial height of the annularly encircling, radially outward-extending extension 13 on the toothed segment 3.

The radially aligned (sealing) surfaces 14 and 20 of the annularly encircling, radially outward-extending extension 13 on the toothed segment 3 or first seal element 13 and of the seal body 18, said surfaces lying axially opposite one another, are designed as radial sealing surfaces (with correspondingly selected materials).

Being pushed axially in the direction of the first seal element 13 by the spring 19, the radial sealing surfaces 14 and 20 of the annularly encircling, radially outward-extending extension 13 on the toothed segment 3 or first seal element 13 and of the seal body 18 are axially opposite one another in sealing contact, wherein a gas cushion 29 builds up in the radial sealing gap (between the radial sealing surfaces 14 and 20).

The sealing of the seal body 18, which can be moved in the stator 17, with respect to the stator 17 is accomplished by means of a seal element 24, in this case an O-ring 24, placed in an (encircling) inner circumferential groove 23 in the seal body 18.

While also delimiting the cavity 41 axially, the labyrinth seal 15 is seated in a centered manner and with an accurate fit on a step-shaped recess 42 in the housing part 16—and, by means of its labyrinth tips 43, seals the pinion shaft 2 or compressor rotor 1. The task of the labyrinth seal 15 is to separate the gas seal 6 from contaminated process gas.

Normally, the cavity 41 will be exposed to purified gas (process gas).

With such a radial alignment of the sealing surfaces 14 and 20 or of the radial sealing contact, the gas seal 6 can be made smaller—by virtue of smaller outside diameters of the components of the gas seal 6.

As a result, the peripheral speed at the rotating first seal element 13 is lower, with the result, in turn, that higher speeds can be achieved with the compressor rotor 1.

By means of the play-free centering 26 of the toothed segment 3, which is clamped in a play-free, centered manner by the serrated joints, the rotating seal element 13 of the gas seal 6—which seal element is connected integrally to the toothed segment 3—is thus also centered without play.

Here too, additional centering elements and also tight tolerances for the components are no longer necessary. Rotation-induced shifting (centrifugal force) of the axis of rotation of the rotating first seal element 13, which would lead to operating unbalance, is also prevented. (Component) costs, weight and/or additional assembly steps and/or processing steps are thus likewise eliminated by embodiments of the invention or on no longer necessary.

Although the invention has been illustrated and described more specifically in detail by means of the preferred illustrative embodiments, the invention is not restricted by the examples disclosed, and other variants can be derived therefrom by a person skilled in the art without exceeding the scope of protection of the invention.

The invention claimed is:

1. A compressor rotor used in a geared turbocompressor, comprising:

a pinion shaft, which has a plurality of interconnected segments that are arranged axially in series, and having a multipart seal, which seals the pinion shaft, wherein the pinion shaft has an impeller segment, which carries an impeller, a connection segment, and a toothed segment arranged axially between the impeller segment and the connection segment, the toothed segment having two axial ends and toothing at each of the two axial ends, whereby the toothed segment is held axially between the impeller segment and the connection segment by means of corresponding mating toothing at ends of the impeller segment and of the connection segment, and on which toothed segment a seal element of the multipart seal is arranged, the seal element being connected to the toothed segment;

wherein the toothed segment is arranged on a sleeve that is sealed with respect to the toothed segment;

wherein the toothing and/or the mating toothing is serrated toothing;

wherein the multipart seal sealing the pinion shaft is a gas seal the gas seal being at least one of a single and a double gas seal.

2. The compressor rotor as claimed in claim 1, further comprising a labyrinth seal, which is arranged on the toothed segment.

3. The compressor rotor as claimed in claim 1, wherein the seal element of the multipart seal is connected at least nonpositively to the toothed segment, and is formed in positive engagement or integrally with the toothed segment.

4. The compressor rotor as claimed in claim 1, wherein the seal element of the multipart seal is connected at least nonpositively to the toothed segment, and has a substantially radial sealing surface.

5. The compressor rotor as claimed in claim 1, further comprising a further seal element of the multipart seal arranged in a manner which allows substantially axial movement by means of a spring , in a stator arranged on a housing element, and which has a substantially radial sealing surface, which lies axially opposite the substantially radial sealing surface of the seal element of the multipart seal, the seal element being connected at least nonpositively to the toothed segment.

6. The compressor rotor as claimed in claim 1, wherein the plurality of interconnected segments of the pinion shaft are clamped by means of a reduced-shank bolt, whereby the toothed segment is held clamped axially between the impeller segment and the connection segment.

* * * * *